United States Patent [19]

Van Effen

[11] Patent Number: 4,861,443

[45] Date of Patent: Aug. 29, 1989

[54] PROCESS FOR PREPARING 4,4'-ISOPROPYLIDENEDITHIO-BIS-(2,6-DI-TERTIARYBUTYLPHENOL) BY ELECTROCATALYSIS

[75] Inventor: Richard M. Van Effen, Midland, Mich.

[73] Assignee: Merrell Dow Pharmaceuticals Inc., Cincinnati, Ohio

[21] Appl. No.: 209,763

[22] Filed: Jun. 22, 1988

Related U.S. Application Data

[62] Division of Ser. No. 3,115, Jan. 14, 1987, Pat. No. 4,772,363.

[51] Int. Cl.[4] ..... C25B 3/00

[52] U.S. Cl. ..... 204/72; 204/73 R; 204/78

[58] Field of Search ..... 204/73 R, 72, 78

[56] References Cited

U.S. PATENT DOCUMENTS

| | | | |
|---|---|---|---|
| 3,576,883 | 4/1971 | Neuworth | 568/47 |
| 3,952,064 | 4/1976 | Whalley | 568/381 |
| 4,072,584 | 2/1978 | Cipris et al. | 204/73 R |
| 4,705,620 | 11/1987 | Bricker et al. | 204/73 R |
| 4,719,237 | 1/1988 | McCaughan | 514/821 |
| 4,734,527 | 3/1988 | Krauss | 567/47 |

*Primary Examiner*—John F. Niebling
*Assistant Examiner*—Steven P. Marquis
*Attorney, Agent, or Firm*—Louis J. Wille

[57] ABSTRACT

This invention relates to an improvement in a process for making 4,4'-isopropylidenedithio-bis-(2,6-di-tertiarybutylphenol), which is effected by carrying out an electrocatalytic reduction of bis(3,5-di-tertiarybutyl-4-hydroxyphenol)polysulfide at a lead cathode in an acidic electrolyte medium.

6 Claims, No Drawings

PROCESS FOR PREPARING 4,4'-ISOPROPYLIDENEDITHIO-BIS-(2,6-DI-TERTIARYBUTYLPHENOL) BY ELECTROCATALYSIS

This is a divisional of application Ser. No. 003,115, filed Jan. 14, 1987 now U.S. Pat. No. 4,772,363.

BACKGROUND OF THE INVENTION

1. Field of the Invention

This invention relates to a novel, improved process of preparing 2,6-di-tertiarybutyl-4-ercaptophenol by an electrocatalytic reduction of bis(3,5-di-tertiarybutyl-4-hydroxyphenol)polysulfide at a lead cathode in an acidic electrolyte medium. This mercaptophenol is an intermediate in the synthesis of 4,4'-isopropylidenedithio-bis-(2,6-di-tertiarybutylphenol) which has been disclosed in U.S. Pat. No. 3,576,883 as an effective pharmaceutical agent for the reduction of serum cholesterol.

In addition, the above method carried out in the presence of acetone results in a novel, improved process of making 4,4'-isopropylidenedithio-bis-(2,6-di-tertiarybutylphenol)in a single step procedure.

2. Description of the Prior Art

U.S. Pat. No. 3,479,407 teaches the preparation of a mixture of bis(3,5-di-tertiarybutyl-4-hydroxyphenol)polysulfides, comprising principally the disulfide, by a process of sulfurization of 2,6-di-tertiarybutylphenol (DTBP) with sulfur monochloride in the presence of an iodine catalyst. The polysulfides have been shown to be reduced to 2,6-di-tertiarybutyl-4-mercaptophenol by a process comprising a Zn/HCl reduction as disclosed in U.S. Pat. Nos. 3,952,064 and 3,479,407 and in Japanese Patent Application No. 73-28425. Condensation of the resulting mercaptophenol in the presence of acetone under acidic conditions results in the formation of 4,4'-isopropylidenedithio-bis-(2,6-di-tertiarybutylphenol), as described in U.S. Pat. No. 3,576,883. This reaction sequence is presented below.

1.

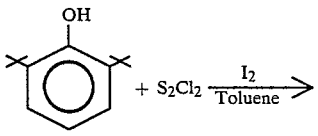

(I)
DTBP

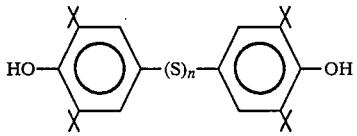

(II)
Polysulfide

2.

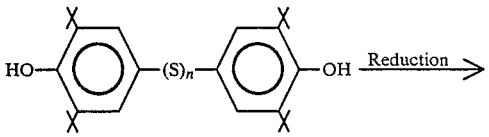

(II)
Polysulfide

-continued

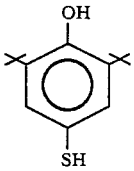

(III)
Mercaptophenol

3.

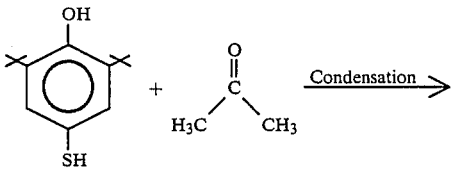

(III)
Mercaptophenol

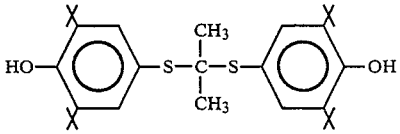

(IV)
4,4'-isopropylidenedithio-bis-(2,6-di-tertiarybutylphenol)

+ = tertiarybutyl group
n = 2, 3, 4, . . . ; principal product is the disulfide

It is generally known that organic disulfide compounds can be reduced to the corresponding mercaptans by electrocatalysis at a mercury cathode, where mercury cleaves the sulfur-sulfur bond in an initial chemical step to form the mercury mercaptide salt, followed by electrochemical reduction of the salt to the mercaptan (J. Q. Chambers, "Organic Sulfur Compounds" in "Encyclopedia of Electrochemistry of the Elements", Vol. 12, A. J. Bard, Editor, Marcel Dekker, New York, 1978, pp 393–409). There is some precedent for electrocatalytic reduction of an organic disulfide at a lead cathode. Thioglycolic acid has reportedly been obtained by electrocatalytic reduction of dithiodiglycolic acid at a lead cathode in 2N sulfuric acid (E. Larson, Ber. Dtsch. Chem. Ges., 61, 1439 (1928).

SUMMARY OF THE INVENTION

The following terms are used herein as follows:

"DTBP" refers to 2,6-di-tertiarybutylphenol (I).

"Polysulfide" and "Bis(3,5-di-tertiarybutyl-4-hydroxyphenol)polysulfide" both are used to refer to one or more species of bis(3,5-di-tertiarybutyl-4-hydroxyphenol)polysulfide (II) including9 the di-, tri-, tetra-, and other higher order sulfides, and including single species as well as mixtures thereof. Typically, the Polysulfide is a mixture of two or more species with the disulfide present in amounts greater than other species.

"Mercaptophenol" refers to 2,6-di-tertiarybutyl-4-mercaptophenol (III).

"Modified SCE reference electrode" is defined as a tetrabutylammonium chloride-filled saturated calomel electrode. This typically is used as a reference electrode in measuring applied potentials in nonaqueous media.

"Lower alkanol" is defined as a hydroxy-substituted alkane of 1 to 6 carbon atoms.

The novel improvement in the process of synthesizing the Mercaptophenol (III) comprises carrying out an electrocatalytic reduction of the Polysulfide (II) at a lead cathode in an acidic electrolyte medium. In one embodiment, this electrocatalytic reduction is carried out in the presence of acetone in the acidic electrolyte medium, which results in the synthesis of 4,4'-isopropylidenedithio-bis-(2,6-di-tertiarybutylphenol) in a single step procedure.

Generally, a voltage is applied across the lead cathode and an appropriate anode in a mixture comprising the Polysulfide (II) in an acidic electrolyte medium. The preferred voltage is equal to or greater than about −0.5 volts (V) (as measured between the lead cathode and modified SCE reference electrode) with the preferred anode comprising a graphite electrode contacting the electrolyte medium by means of a glass frit. The acidic electrolyte medium comprises a Lewis acid in a solvent suitable to support the electrocatalytic reaction. This solvent is generally one in which the Polysulfide (II) is sufficiently soluble and one which is compatible with the electrocatalytic reduction. The preferred acidic electrolyte medium comprises a protonic acid, in a lower alkanol, with 1.0 molar (M) hydrochloric acid in methanol being most preferred.

Conducting the above electrocatalytic reduction in the presence of a sufficient amount of acetone in the electrolyte medium, preferably in a molar ratio of acetone to the Polysulfide (II) of at least about one, results in 4,4'-isopropylidenedithio-bis-(2,6-di-tertiarybutylphenol) being formed in a single step procedure.

While the actual reaction mechanism remains unknown, it is likely that the above process involves a mechanism in which lead cleaves the disulfide bond in an initial chemical step followed by electrochemical reduction of the lead mercaptide salt to give the Mercaptophenol (III).

$$R{-}S{-}S{-}R + Pb^{\circ} \rightarrow Pb(SR)_2$$

$$Pb(SR)_2 + 2H^+ + 2e' \rightarrow Pb^{\circ} + 2RSH$$

In the presence of acetone and acid the Mercaptophenol (III) is condensed with acetone to form 4,4'-isopropylidenedithio-bis-(2,6-di-tertiarybutylphenol) as follows:

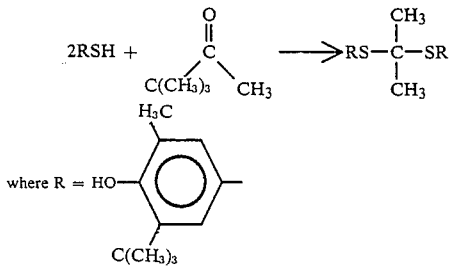

The present invention, however, is understood not to be limited by any particular theory or mechanism in bringing about the improvement in the process of preparing the Mercaptophenol (III) and 4,4'-isopropylidenedithio-bis-(2,6-di-tertiarybutylphenol).

The following examples illustrate that an electrochemical process utilizing a lead cathode in an acidic electrolyte medium is effective - unlike methods utilizing alternative cathode compositions such as silver, gold, tungsten, copper, molybdenum, stainless steel, and $RuO_2/ZrO_2/Ti$- in catalyzing the reduction of the Polysulfide (II) to the Mercaptophenol (III) at efficient negative potentials. In addition, this process utilizing a lead cathode is shown to be effective in the synthesis of 4,4'-isopropylidenedithio-bis-(2,6-di-tertiarybutylphenol) in a single step procedure from the Polysulfide (II) in the presence of acetone.

EXAMPLE 1

Cyclic Voltammetry with Various Cathode Materials

Various cathode materials including lead, silver, gold, molybdenum, tungsten, copper, stainless steel, and $RuO_2/ZrO_2/Ti$ were tested by the technique of cyclic voltammetry for their ability to catalyze the reduction of Polysulfide (II) to Mercaptophenol (III) in an acidic electrolyte medium. The amount of current flowing in the electrolyte medium in the presence and absence of Polysulfide (II) was monitored as a negative potential was applied between the test cathode and the anode. The negative potential was gradually increased to a maximum and then decreased to the starting potential at a constant rate. Electrodes for cyclic voltammetry were prepared as follows: A cylindrical billet of the electrode material was press-fitted into the end of a Teflon or glass-filled Teflon rod to provide a circular exposed disc 3–5 mm in diameter, and electrical contact was made to a brass pin either with solder or silver containing epoxy resin. The $RuO_2/ZrO_2/Ti$ material was prepared according to a published procedure, (Barke, L. D., McCarthy, M., Electrochimica Acta, 29, 211 (1984)). In these tests the electrolyte medium consisted of 0.5M HCl in 50% methanol/50% benzene and a scan rate of 200 millivolts (mV) per second was utilized between applied potentials of about −0.2V and about −1.1V. These scans were performed in the presence and absence of added Polysulfide (II). The amount of current generated was monitored as a function of the applied potentials which were measured versus a modified SCE reference electrode.

Of the materials tested, only molybdenum and lead showed a significant increase in reductive current in the presence of Polysulfide (II) over that seen in the absence of the Polysulfide (II). With molybdenum, this increase in reductive current occurred at the same general potential at which $H_2$ evolution commences. With the lead cathode, the increase in reductive current occurred at potentials which are substantially below that at which $H_2$ evolution commences. This difference between the lead and molybdenum cathodes in the potentials at which reduction of Polysulfide (II) occurs demonstrates a considerable advantage of the lead cathode. Unlike the molybdenum cathode, the lead cathode can catalyze the reduction of Polysulfide (II) at potentials at which substantial concurrent generation of $H_2$ gas does not occur. Use of the lead cathode thus avoids the fire and explosion hazard associated with the generation of $H_2$ gas as well as providing a more efficient reduction process with less by-product formation.

EXAMPLE 2

Preparation of Mercaptophenol by Electrocatalysis at a Lead Cathode

A lead preparative-scale electrode was fabricated from lead sheet and was formed as an all-lead unit consisting of a 3-inch diameter disc with supporting legs and a long lead rod for electrical contact. The entire electrode was immersed in an electrolyte medium in a 1-liter coulometry cell, with a magnetic stirrer bar rotating on the center of the lead disc to effect mass transport.

A preparative-scale lead cathode and a graphite anode fitted with a glass frit to effect contact with the electrolyte medium, were immersed in 600 ml of 1.0M HCl in methanol and a potential of −0.6 V was applied across the electrodes. Applied potentials were measured versus that of a modified SCE electrode. Two grams of Polysulfide (II) were added and current immediately began to flow. The reaction was allowed to proceed to completion and the resulting product was isolated. Analysis of the product indicated that it consisted primarily of the Mercaptophenol (III).

EXAMPLE 3

Preparation of 4,4'-Isopropylidenedithio-bis-(2,6-di-tertiarybutylphenol) by Electrocatalysis at a Lead Cathode The above reaction was repeated applying −0.7 V to 600 ml of an electrolyte medium consisting of 0.5M HCl in 50% methanol/25% toluene/25% acetone. The product was isolated from the organic layer after washing with 10% aqueous $Na_2CO_3$. Analysis indicated that the product consisted primarily of 4,4'-isopropylidenedithio-bis-(2,6-di-tertiarybutylphenol).

These experimental runs clearly demonstrate that the Mercaptophenol (III) can be effectively synthesized from the Polysulfide (II) by a novel process comprising an electrocatalytic reduction of the Polysulfide (II) at a lead cathode in an acidic electrolyte medium, and that 4,4'-isopropylidenedithio-bis-(2,6-ditertiarybutylphenol) is produced when this electrocatalytic reaction is carried out in the presence of acetone.

It is understood that the foregoing detailed description is given merely by way of illustration and that many modifications may be made therein without departing from the spirit or scope of the present invention.

What is claimed is:

1. In a process for making 4,4'-isopropylidenedithio-bis-(2,6-di-tertiarybutylphenol) by reduction of bis(3,5-di-tertiarybutyl-4-hydroxyphenol)polysulfide and reaction of the product with acetone, the improvement which comprises carrying out the reduction electrocatalytically at a lead cathode in an acidic electrolyte medium containing acetone and isolating 4,4'-isopropylidenedithio-bis-(2,6-di-tertiarybutylphenol) from the medium.

2. A process of claim 1 wherein the electrolyte medium comprises protonic acid in a lower alkanol.

3. A process of claim 1 wherein the electrolyte medium comprises hydrochloric acid in methanol.

4. A process of claim 1 wherein an electronegative potential of about −0.5 volts is maintained at the lead cathode.

5. A process of claim 1 wherein the molar ratio of acetone to bis(3,5-di-tertiarybutyl-4-hydroxyphenol)polysulfide is one or greater.

6. A process of claim 1 further comprising the step of separating 4,4'-isopropylidenedithio-bis-(2,6-ditertiarybutylphenol) from the reaction mixture.

* * * * *